US005934023A

United States Patent [19]

Gurzenda et al.

[11] Patent Number: 5,934,023

[45] Date of Patent: Aug. 10, 1999

[54] DOOR HARDWARE PROTECTION DEVICE

[75] Inventors: William Gurzenda; Boyd Thomas, both of Rockwood, Pa.

[73] Assignee: Rockwood Manufacturing Company, Rockwood, Pa.

[21] Appl. No.: 08/956,366

[22] Filed: Oct. 23, 1997

Related U.S. Application Data

[60] Provisional application No. 60/029,820, Oct. 25, 1996.

[51] Int. Cl.[6] ..... E05B 1/00

[52] U.S. Cl. ..... 49/460

[58] Field of Search ..... 49/460, 461; 16/111 R, 16/DIG. 1, DIG. 2, DIG. 5; 211/87, 88

[56] References Cited

U.S. PATENT DOCUMENTS

| | | | |
|---|---|---|---|
| 1,090,562 | 3/1914 | Orr | 49/460 X |
| 2,870,493 | 1/1959 | Beyrle . | |
| 2,883,714 | 4/1959 | May . | |
| 2,899,718 | 8/1959 | Engels . | |
| 3,858,357 | 1/1975 | McGuire . | |
| 4,095,372 | 6/1978 | Rittner . | |
| 4,344,253 | 8/1982 | Stiles . | |
| 5,042,852 | 8/1991 | Vitt et al. . | |

FOREIGN PATENT DOCUMENTS

| | | | |
|---|---|---|---|
| 3436990 | 4/1986 | Germany | 16/111 R |

*Primary Examiner*—Jerry Redman
*Attorney, Agent, or Firm*—Burns, Doane, Swecker & Mathis, LLP

[57] ABSTRACT

A device for protecting door hardware which projects from a planar surface of a door from damage by a cart being moved past the door. The device is a heavy steel bar, rectangular in cross section, which is bent in a U-shape having two legs and a central planar height portion. The bend on each end between the height and the leg has two complementary acute angles to form a 90° bend.

7 Claims, 3 Drawing Sheets

DOOR HARDWARE PROTECTION DEVICE

REFERENCE TO RELATED APPLICATION

Provisional U.S. patent application No. 60/029,820, filed Oct. 25, 1996 discloses this invention and the priority thereof is hereby claimed.

BACKGROUND OF THE INVENTION

This invention relates to various devices for protecting door opening hardware such as door knobs and related devices, such as those devices commonly called "Panic Bars," from damage by wheeled carts or gurneys which are pushed past doors equipped with such hardware.

A panic bar is usually horizontally mounted on the inner surface of an out-swinging door at a level about three feet above the floor. The panic bar protrudes inwardly from the surface of the door and, at the hinge side of the door, has a protruding edge which is vulnerable to damage by a cart which is being pushed past the door especially when the door is at least partially open when contacted by the wheeled cart.

SUMMARY OF THE INVENTION

The present invention in a first embodiment is an integral flattened "U" shape body made of a strong material such as stainless steel bar stock. The body has two legs for securing to a door adjacent the hardware to be protected. Between the two legs is an elongate bight portion which will extend generally parallel to the outer surface of the door upon which the body is mounted.

Each junction between a leg and the bight is made up of two spaced apart bends so as to present a corner having a first bend, a straight portion and a second bend. This type of bend is strong to resist impact while at the same time presenting an outer surface over which a protruding corner of a cart can ride.

A second embodiment of this invention is a three dimensional hollow body shaped similar to one quarter of a football. That body presents a curved deflection surface or an angled but planar surface and may be made of heavy molded plastic, fiber reinforced plastic or fiberglass.

Each of these embodiments will furnish a strong surface capable of deflecting carts from contacting hardware projecting from a door surface upon which the invention is mounted.

DETAILED DESCRIPTION OF A PREFERRED EMBODIMENT

Figure 1:
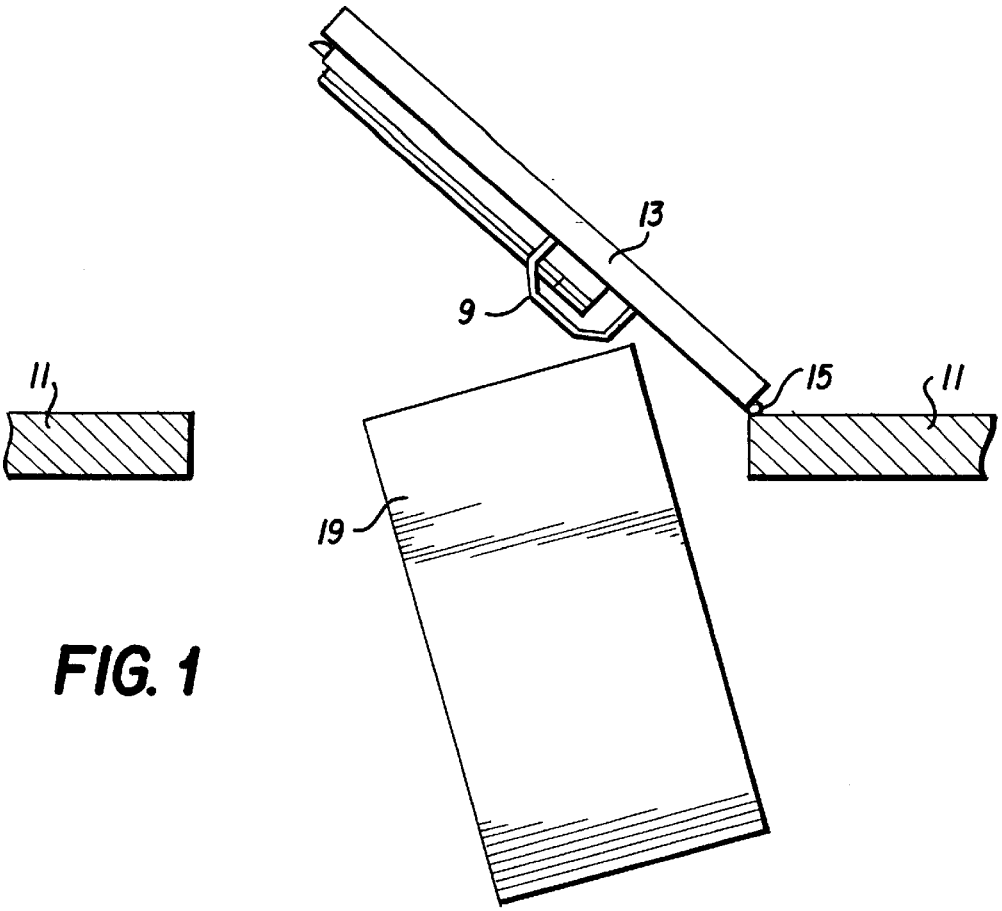
FIG. 1 is a schematic plan view showing a door with a wheeled cart passing the door and contacting a device of the present invention and thus protecting protruding door hardware from damage by the cart.

Referring to FIG. 1, there is shown a wall 11 having an outswinging door 13 pivoted to a doorway in the wall by hinges 15. The door 13 is equipped with a so called "panic bar" 17 opening device. This bar is a door latch release mechanism extending horizontally across the door, about three feet above the floor. It projects about two to four inches outwardly from the planar inside surface of the door and is constructed so that an outward push anywhere along the bar will activate the door latch so that the door can be swung outwardly by continuing to push on the bar.

These panic bar devices generally work very satisfactorily and are required for some exit doors in public buildings such as schools and hospitals. In such buildings it is usual to use wheeled carts or gurneys for transporting goods from one area to another. Usually the cart attendant does not carefully open the door by hand, but instead pushes the cart 19 directly against the panic bar to open the door. This procedure can work satisfactorily if the cart 19 contacts the bar 17 at a point spaced away from the hinge end of the bar.

However, because the hinge end of the panic bar projects outwardly from the door surface by the thickness of bar, usually 2 to 4 inches, this end of the bar is exposed and vulnerable to damage by a wheeled cart.

The present invention, in all embodiments, effectively prevents such damage by providing a striking surface which will deflect carts or gurneys away from door hardware adjacent the protection devices of the invention.

Figure 2:
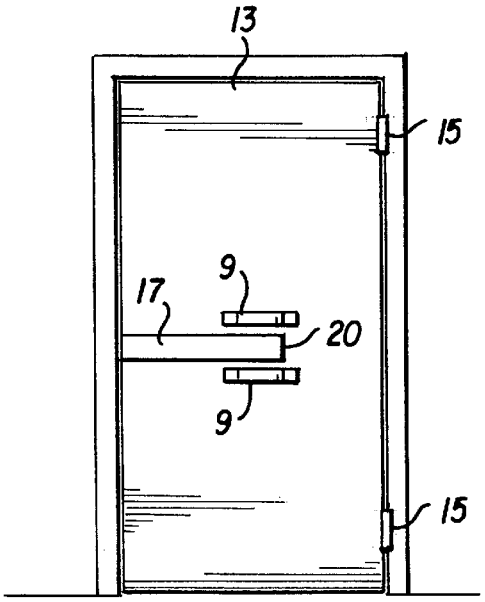
FIG. 2 is a schematic elevational view of a hinged door having door opening hardware which is protected by two devices according to the invention.

FIG. 2 shows a door 13 supported by hinges 15 and having a horizontally extending panic bar 17 for actuating of a latch. The end 20 of the panic bar would be susceptible to damage by a passing cart as shown in FIG. 1. However as shown in FIG. 2 at least one protective device 9 is located adjacent end 20. In the FIG. 2 illustrations two similar devices are located both above and below the panic bar 17. Since the devices 9 project farther out from the door surface than does the panic bar 17, the cart cannot strike the panic bar in the area so protected. The devices 9 extend a shorter horizontal distance than does the panic bar 17 and thus the cart can slide along the outer surfaces of the devices 9 until it can contact the panic bar 17 near the middle thereof. Thus the cart can be used to push against the panic bar 17 to actuate the door latch and open the door.

Figure 4:
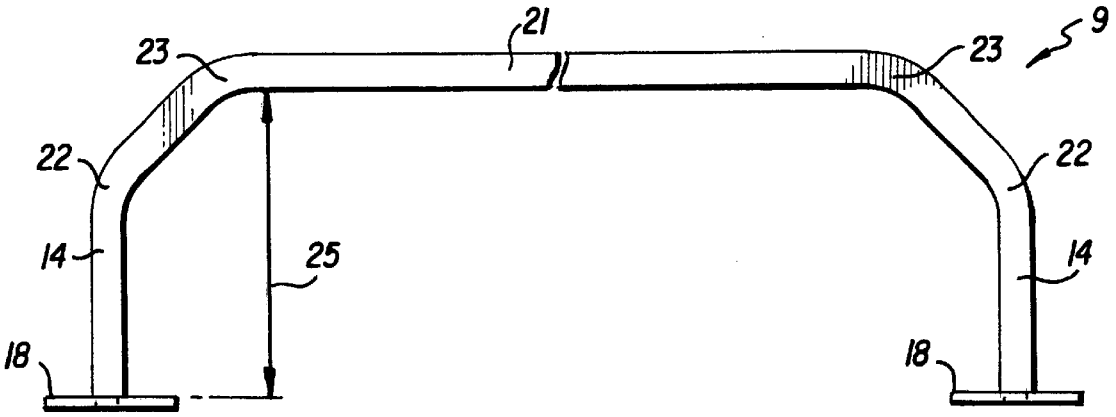
FIG. 4 is an elevational view of a hardware protection device of the first embodiment of the invention.
Figure 5:
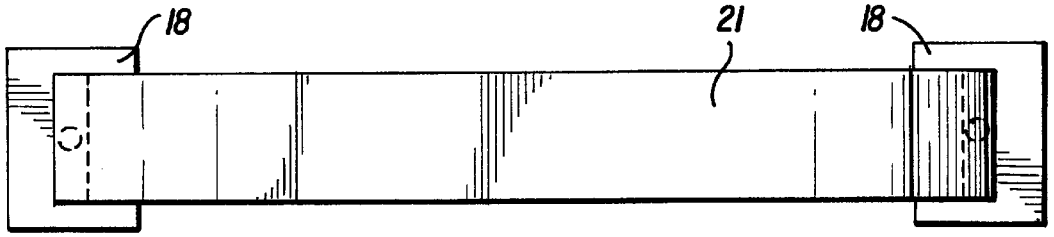
FIG. 5 is a plan view of the device of FIG. 4.

FIG. 4 shows the device 9 in detail, it is preferably made of ⅜ inch thick stainless steel bar stock which is 1½ inches wide. In a preferred embodiment the device is about 8 inches long and has a mounting plate 18 at the end of each leg 14. The bight portion 21 is connected at each of its ends to a leg 14 by two bends 22 and 23, each bend being about 45°. Thus the straight portion between bends 22 and 23 is at an angle of 45° to the bight portion 21 and is about 1¼ inches long. The height dimension 25 is selected to be slightly greater than the projection of the hardware to be protected. Alternatively, the bends 12 and 23 could be complementary acute angles other than two 45° angles, for example 30° and 60°. The legs 14 are preferably the same length. The length is selected according to the projection of the hardware, usually 2 to 4 inches.

In addition to the placement of the devices 9 as shown above and below the panic bar in FIG. 2, it is contemplated that the devices 9 could be placed in other positions depending upon local conditions, for example two devices 9 placed end-to-end under the panic bar or end-to-end above the panic bar.

Figure 3:
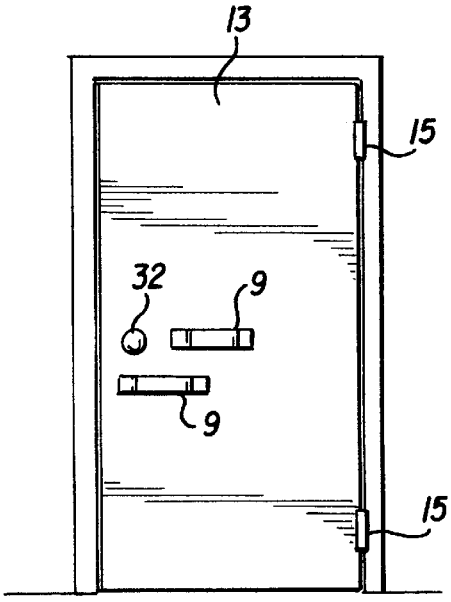
FIG. 3 is a view similar to FIG. 2 but showing an arrangement with a door knob.

As shown in FIG. 3 the hardware to be protected is a door knob 32. It is protected by a first device 9 placed immediately to the right of the knob, on the hinge side of the knob and a second device 9 below the knob, thus keeping the knob readily accessible. As shown in FIG. 3 the right end of the lower device 9 extends horizontally past the left end of the upper device 9, thus insuring a protruding surface which is, in effect, continuous so that the cart edge cannot contact the knob 32, even when passing thereover.

Figure 6:
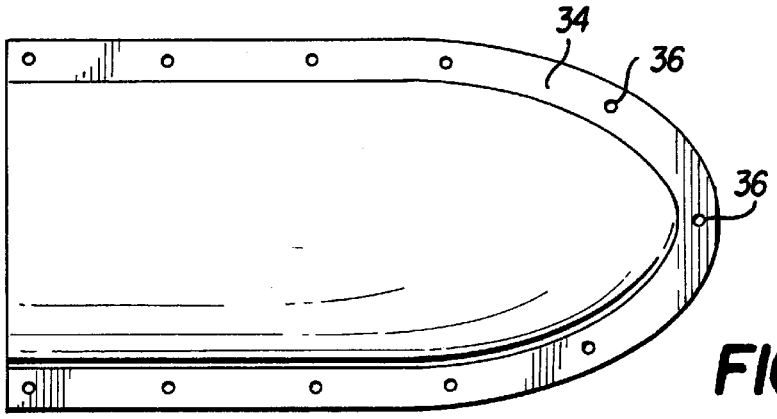
FIG. 6 is a plan view of a door hardware protection device according to the second embodiment.
Figure 7:
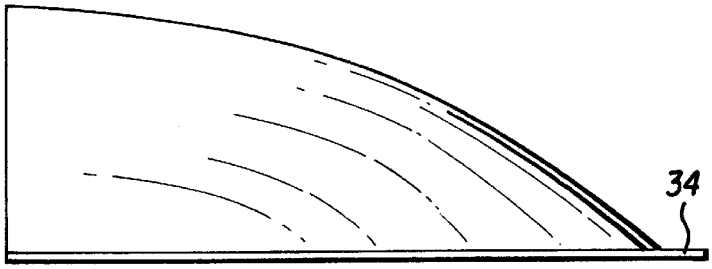
FIG. 7 is an elevational view of the device of FIG. 6.

Referring now to FIG. 6 and 7, there is shown an integral hollow body, generally shaped like one quarter of a football but with a bent out peripheral flange 34 having a plurality of mounting holes 36. This hollow body can be positioned on a door surface adjacent the hinge end of a panic bar so as to encompass the end thereof and thus protect that end from contact by a cart passing the door.

Figure 8:
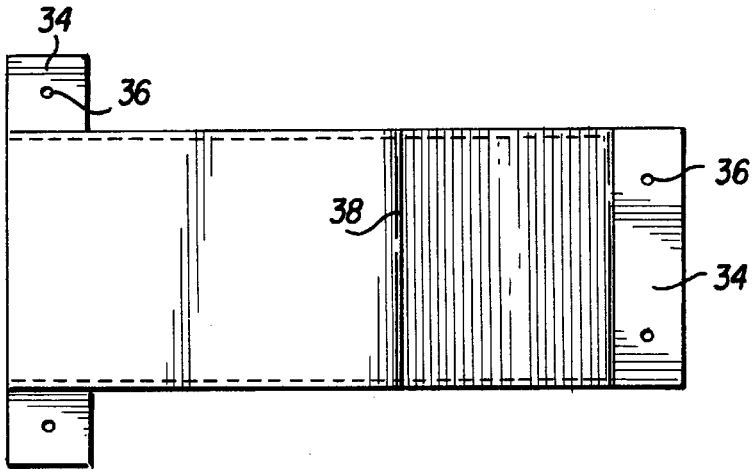
FIG. 8 is a plan view of a door hardware protection device according to a modification of the second embodiment.
Figure 9:
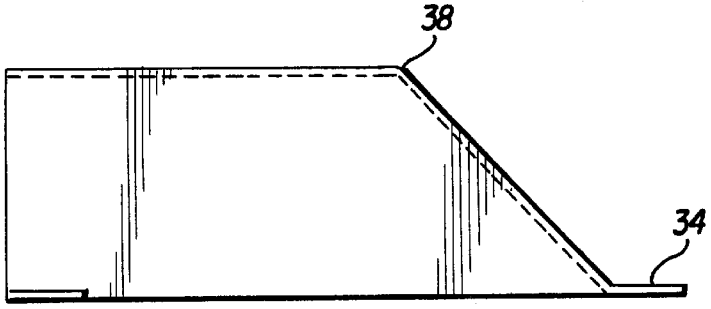
FIG. 9 is an elevational view of the device of FIG. 8.

The construction shown in FIGS. 8 and 9 is similar to that of FIGS. 6 and 7 except that instead of the hollow body being of curved configuration it instead has planar parallel sides and two planar surfaces on its top, which meet each other at bend point 38.

We claim:

1. A device protecting a door hardware projecting from a planar surface of a door from damage by objects being moved past said door, said device comprising:

an elongate body having a rectangular cross section, said body being bent in a general U-shape configuration which has two legs secured to said planar door surface, an elongate bight portion between said two legs, said bight portion being planar across its length except at its ends which connect to said legs;

each said bight end having a bent portion at a first acute angle and each said leg having a connecting bent portion at a second acute which is a complement to said first acute angle and a planar area between said first and second acute angles, the arrangement being such that the legs are substantially perpendicular to said bight portion and there is a planar area adjacent each end of the bight portion which lies at an angle to both the leg and the bight portion.

2. The device of claim 1 in which the two legs are of substantially the same length and said first and second acute angles are each about 45°.

3. A device protecting a door hardware projecting from a planar surface of a door from damage by objects being moved past said door, said device comprising:

an elongate hollow body having a U-shaped cross section with said cross section being of greater height at one end of the body than at the other end of the body, a plane of the cross section being perpendicular to an axis passing through the ends of the body, the width of said body being substantially the same along a major part of the length thereof, said greater height end being of a size and shape to encompass a portion of the door hardware to be protected.

4. The device of claim 3, in which said U-shaped cross section is curvilinear over its surface.

5. The device of claim 3, in which said U-shaped cross section has two generally parallel planar sidewalls and a planar top wall over a major portion of its length.

6. The device of claim 3 in which said body has an outwardly extending flange around at least a portion of its length.

7. A door, comprising:

a planar surface for mounting a door hardware thereon;

a door hardware projecting from the planar surface of the door; and a device for protecting the door hardware from damage by objects being moved past the door, including an elongate hollow body having a U-shaped cross section with the cross section being of greater height at one end than at the other end, the width of the body being substantially the same along a major part of the length thereof, wherein the greater height end encompasses a portion of the door hardware.

* * * * *